US010253557B2

(12) United States Patent
Frede

(10) Patent No.: US 10,253,557 B2
(45) Date of Patent: Apr. 9, 2019

(54) ROLLER SHUTTER FOR OPENING AND CLOSING A DOORWAY

(71) Applicant: ASSA ABLOY Entrance Systems AB, Landskrona (SE)

(72) Inventor: Friedhelm Frede, Erwitte (DE)

(73) Assignee: ASSA ABLOY ENTRANCE SYSTEMS AB, Landskrona (SE)

( * ) Notice: Subject to any disclaimer, the term of this patent is extended or adjusted under 35 U.S.C. 154(b) by 281 days.

(21) Appl. No.: 15/128,050

(22) PCT Filed: Mar. 24, 2015

(86) PCT No.: PCT/EP2015/056301
§ 371 (c)(1),
(2) Date: Sep. 21, 2016

(87) PCT Pub. No.: WO2015/144729
PCT Pub. Date: Oct. 1, 2015

(65) Prior Publication Data

US 2017/0101818 A1 Apr. 13, 2017

(30) Foreign Application Priority Data

Mar. 25, 2014 (SE) ..... 1450346

(51) Int. Cl.
*E06B 9/17* (2006.01)
*E06B 9/18* (2006.01)
(Continued)

(52) U.S. Cl.
CPC ..... *E06B 9/15* (2013.01); *E06B 9/17* (2013.01); *E06B 9/171* (2013.01);
(Continued)

(58) Field of Classification Search
CPC ..... E06B 9/18; E06B 9/17061; E06B 9/58; E06B 9/17; E06B 9/60; E06B 2009/1743
(Continued)

(56) References Cited

U.S. PATENT DOCUMENTS 983,663 A * 2/1911 McCloud ..... E06B 9/15 160/133
1,014,315 A * 1/1912 McCloud ..... E06B 9/15 160/133
(Continued)

FOREIGN PATENT DOCUMENTS

CA 2935969 A1 * 10/2015 ..... E06B 9/15
DE 3917080 A1 * 12/1989 ..... E06B 9/34
(Continued)

OTHER PUBLICATIONS

International Search Report and Written Opinion dated Jun. 3, 2015 in corresponding International Application No. PCT/EP2015/056301.
(Continued)

*Primary Examiner* — Robert Canfield
(74) *Attorney, Agent, or Firm* — Wissing Miller LLP

(57) ABSTRACT

The invention relates to a roller shutter for opening and closing a doorway (12) having a door blade (11), the door blade (11) comprises several rigid shutter elements (13) which are hinged with each other, the shutter elements (13) are guided by side rails (18) at opposed sides of the doorway (12), wherein each shutter element (13) provides an end piece (19) at each horizontally spaced end of the shutter element (13) for spacing layers of rolled up shutter elements (13) apart from each other, each end piece (19) has at least one concave section (27) for coiling the end pieces (19) on a coiling device (14) and/or in layers on top of each other. For reducing the risk of weakening a connection between the end piece (19) and the shutter element (13), for reducing
(Continued)

Figure 1:
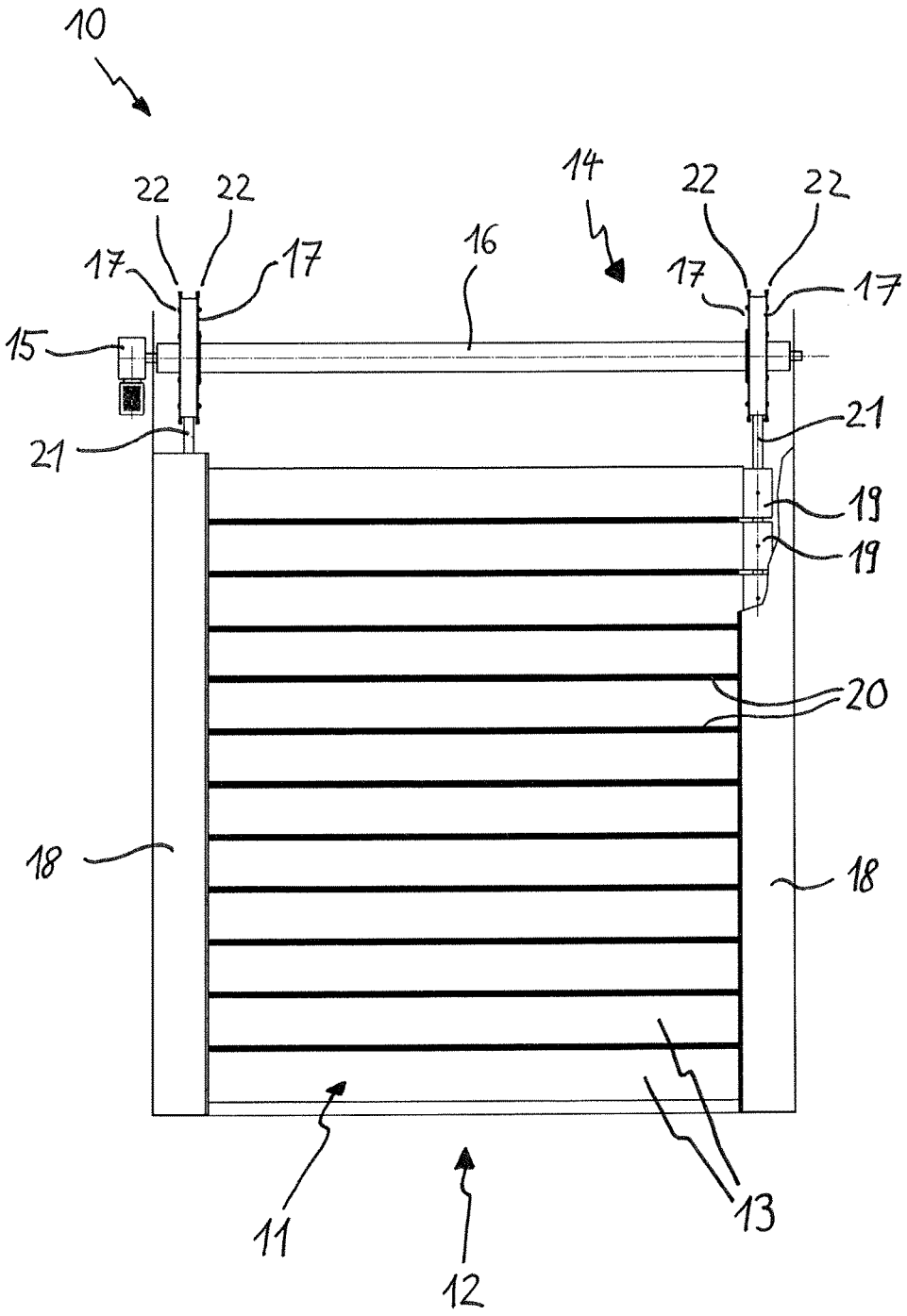

noise and/or vibrations during the opening and/or closing of the door way and/or to increase the stability of the roller shutter the roller shutter (10) is characterized in that at least some of the end pieces (19) having at least one plane gliding section (28), the plane gliding section (28) is arranged for interacting with a slide guide (36) of the side rail (18) for leading the end pieces (19) into and/or out of the side rails (18).

18 Claims, 7 Drawing Sheets

(51) Int. Cl.

| | |
|---|---|
| ***E06B 9/58*** | (2006.01) |
| ***E06B 9/60*** | (2006.01) |
| ***E06B 9/174*** | (2006.01) |
| ***E06B 9/15*** | (2006.01) |
| ***E06B 9/171*** | (2006.01) |

(52) U.S. Cl.
CPC ..... *E06B 9/17061* (2013.01); *E06B 9/17076* (2013.01); *E06B 9/18* (2013.01); *E06B 9/58* (2013.01); *E06B 9/582* (2013.01); *E06B 9/60* (2013.01); *E06B 2009/155* (2013.01); *E06B 2009/1522* (2013.01); *E06B 2009/1561* (2013.01); *E06B 2009/1566* (2013.01); *E06B 2009/1577* (2013.01); *E06B 2009/1594* (2013.01); *E06B 2009/1743* (2013.01)

(58) Field of Classification Search
USPC ..... 160/133, 231.1
See application file for complete search history.

(56) References Cited

U.S. PATENT DOCUMENTS

| | | | | | |
|---|---|---|---|---|---|
| 1,081,202 | A * | 12/1913 | Brunst | E06B 9/15 | 160/133 |
| 1,295,712 | A * | 2/1919 | Drew | E06B 9/15 | 160/133 |
| 5,253,694 | A * | 10/1993 | Bernardo | E06B 9/581 | 160/133 |
| 8,985,179 | B2 * | 3/2015 | Steffen | E06B 9/171 | 160/133 |
| 2003/0047291 | A1 * | 3/2003 | Klein | E06B 9/15 | 160/133 |
| 2011/0265959 | A1 * | 11/2011 | Frede | E06B 9/15 | 160/133 |
| 2012/0012262 | A1 * | 1/2012 | Santoro | E06B 9/42 | 160/272 |
| 2015/0361715 | A1 * | 12/2015 | Frede | E06B 9/60 | 160/133 |
| 2017/0152705 | A1 * | 6/2017 | Frede | E06B 9/17076 | |

FOREIGN PATENT DOCUMENTS

| | | | | | |
|---|---|---|---|---|---|
| DE | 4234359 | A1 * | 4/1993 | E06B 9/60 | |
| DE | 44 39 718 | A1 | 5/1996 | | |
| DE | 197 06 314 | A1 | 8/1998 | | |
| DE | 100 11 789 | A1 | 9/2001 | | |
| DE | 10011789 | A1 * | 9/2001 | E06B 9/15 | |
| DE | 202 00 137 | U1 | 5/2002 | | |
| EP | 0052320 | A1 * | 5/1982 | | |
| EP | 0 056 650 | A2 | 7/1982 | | |
| EP | 0056560 | A2 * | 7/1982 | E06B 9/34 | |
| EP | 2690245 | A1 * | 1/2014 | E06B 9/17061 | |
| FR | 2 746 845 | A1 | 10/1997 | | |
| GB | 191315683 | A * | 11/1913 | E06B 9/15 | |
| GB | 1 013 644 | A | 12/1965 | | |
| GB | 1449461 | A * | 9/1976 | | |
| JP | 2002-161681 | A | 6/2002 | | |
| WO | WO-2009148460 | A1 * | 12/2009 | E06B 9/15 | |

OTHER PUBLICATIONS

International-Type Search Report dated Oct. 16, 2014 in corresponding Sweden Priority Application No. 1450346-0.

* cited by examiner

ROLLER SHUTTER FOR OPENING AND CLOSING A DOORWAY

CROSS-REFERENCE TO RELATED APPLICATIONS

This application is the National Stage entry under 35 U.S.C. § 371 of International Application No. PCT/EP2015/056301 filed on Mar. 24, 2015, published on Oct. 1, 2015 under Publication Number WO 2015/144729 A1, which claims the benefit of priority under 35 U.S.C. § 119 of Sweden Patent Application Number 1450346-0 filed Mar. 25, 2014.

The invention relates to a roller shutter for opening and closing a doorway having a door blade, the door blade comprises several rigid shutter elements which are hinged with each other, the shutter elements are guided by side rails at opposed sides of the doorway, wherein each shutter element provides an end piece at each horizontally spaced end of the shutter element for spacing layers of rolled up shutter elements apart from each other, each end piece has at least one concave section for coiling the end pieces on a coiling device and/or in layers on top of each other.

Such a roller shutter or rollup door is known from document DE 100 11 789 A1.

Roller shutters or rollup doors may be used in industrial facilities, such as factories, warehouses, garages, and the like to selectively cover doorways or guard machinery in order to provide security, as well as protection from debris and/or unwanted climatic variations.

A drawback of known roller shutters, preferably of high speed roller doors with rigid shutter elements, is that a torque and/or bending moment may act on the end pieces. Preferably at roller shutters with a top roll barrel and/or a coiling device having a stationary bearing for a rotatable axis which does not allow any movement of the axis in the horizontal and vertical direction the shutter elements enter and/or leave the side rail in different angles in regard to the vertical. If the doorway is nearly closed the shutter elements run over and/or along an inner side or inner radius of an opening at an upper end of the side rail. If the doorway is partly, preferably half, closed or opened the shutter elements run straight or substantially vertically into or out of the side rail. If the doorway is nearly fully open the shutter elements run over and/or along an outer side or outer radius of an opening at an upper end of the side rail.

The end pieces of the shutter elements may be fixed to a lifting device or carrying strap for lifting and lowering the door blade. Preferably in case of insulated foamed sandwich lamellae used as shutter elements the end pieces can only be fixed at the outer sheet wall of the shutter elements with the carrying strap. Thus, a force, a bending moment and/or torque acting, preferably by the carrying strap and/or during the transition from the coiling device into the side rail and/or during the transition from the side rail to the coiling device, on the end pieces leads to a risk of damages. If a force, a bending moment and/or torque acting on the end pieces is to great the connection of the end piece with the shutter element may be weakened and/or loosened. Thus, the end piece may in an extreme case cut off the shutter element.

It is therefore a principal object of the present invention to enhance a roller shutter as mentioned in the preceding introduction such that the risk of weakening a connection between the end piece and the shutter element and/or the risk of cutting the end piece off the shutter element is reduced. Furthermore, it is an object of the present invention to reduce noise and/or vibrations during the opening and/or closing of the door way and/or to increase the stability of the roller shutter.

The object of the invention is accomplished by a roller shutter as mentioned in the preceding introduction, wherein at least some of the end pieces have at least one plane gliding section, the plane gliding section is arranged for interacting with a slide guide of the side rail for leading the end pieces into and/or out of the side rails.

As an advantageous result the end pieces with the plane and/or even gliding section can be guided on the slide guide. In this way the end pieces can be stabilized and/or a force, a bending moment and/or a torque acting on the end piece can be transferred into the slide guide. Preferably the slide guide acts as a counter part for taking a force, a bending moment and/or a torque acting on the end piece. The slide guide may be a separate guide for guiding the end pieces by contacting the gliding section of the end pieces.

A lifting device may be connected with the end pieces to roll up and roll down the shutter elements. A force, a bending moment and/or a torque from the lifting device acting on the end pieces can thereby be transferred into the slide guide and thus the forces on the end pieces are reduced. The end pieces may be fixed to the lifting device. The plane gliding sections of the end pieces may be fixed to the lifting device. A force, a bending moment and/or a torque from the lifting device acting on the plane gliding sections of the end pieces can thereby be directly transferred into the slide guide and thus the forces on the end pieces are further reduced. The lifting device may be connected with the coiling device. The coiling device may be located above the slide guide. The lifting device may be connected with the coiling device above the slide guide. The lifting device may be a carrying strap.

Within the scope of this invention a roller shutter may be a high speed roller door. Preferably a roller shutter comprises several rigid shutter elements as slats, panels and/or lamellae. These shutter elements may form the door blade such that the door blade is moveable at least in a vertical direction for opening and closing the doorway. Preferably a hinged connection of the shutter elements to each other allows the door blade to be rolled up on and/or unrolled of a coiling device of a roller shutter. Preferably a hinged connection of the shutter elements and/or the end pieces allow the transition of the door blade from the substantially vertical plane of the doorway into a substantially spiral arrangement, preferably by up rolling the door blade around a coiling device for opening the doorway, and vice versa. Each shutter element may have two end pieces, wherein the two end pieces are arranged at two horizontally spaced ends of the shutter element respectively.

Furthermore and within the scope of this invention an outer side and/or an outward orientation, preferably of the roller shutter and/or its elements, may be directed and/or facing away from the coiling device. An inner side and/or an inward orientation, preferably of the roller shutter and/or its elements, may be directed and/or facing away from the outer side and/or towards the coiling device. Preferably an inner side and/or an inward orientation is assigned to the side of the roller shutter comprising the coiling device.

According to a further embodiment the thickness of the plane gliding section exceeds the thickness of the concave section for avoiding any abutment of the concave section with the slide guide. Preferably the concave section is arranged at an inner side of the end piece and/or the door blade. The end pieces need the concave section at the inner side for arranging the end pieces in a proper way on an outer circumference of the coiling device and/or onto each other. Preferably the shape of the concave section relates to the roll up radius. Each or at least some of the end pieces may slide along the additional and/or separate slide guide during opening and/or closing the doorway. Without the additional plane gliding section the end pieces and/or edges of the concave sections may hit, especially at high speeds, the slide guide which creates noise and wear. Furthermore, a polygon effect may accurse by the concave sections of the end pieces running along the slide guide. The concave section of an end piece may come at different points in contact with the slide guide. This may lead to a shaking and/or vibration of the end pieces and/or the assigned shutter elements. These disadvantages are avoided by the plane gliding section of the end pieces. As the gliding section is thicker than the concave section and has a straight and/or even gliding face for contacting the slide guide only the gliding section slides along or on the slide guide. Preferably the thickness of the gliding section exceeds the thickness of the concave section by at least 2 mm, especially preferred by at least 4 mm, particularly by at least 5 mm.

The plane and/or even gliding section may extend over the whole height of the end piece. The height of the end piece may be oriented parallel to the longitudinal direction of a carrying strap connected with the end pieces for up rolling and/or unrolling the end pieces together with the shutter elements. Preferably the gliding section may protrude the concave section in the direction of a movement for up rolling and/or unrolling the end pieces. This ensures that the gliding section is the first part of the end piece contacting the slide guide. Preferably edges of the gliding section are rounded for facilitating a smooth transition of the gliding section along the slide guide. The gliding section may be made of a low friction and/or wear-resistant material and/or plastic. The slide guide may be made of metal. In an alternative the gliding section is made of metal and the slide guide is made of a low friction and/or wear-resistant material and/or plastic.

The end piece comprises at least one plane gliding section. Preferably the end piece has one plane gliding section. In an alternative embodiment the end piece may have two, three or even more plane gliding sections. In case of an end piece with a single plane gliding section the gliding section may be arranged in the middle or at a side of the end piece. In case of several plane gliding sections assigned to an end piece a first gliding section may be arranged at a first side of the end piece and a second gliding section may be arranged at a second side of the end piece.

According to a further embodiment of the present invention the gliding section is arranged between a first concave section and a second concave section. Preferably the gliding section is arranged in the middle between the first and second concave section. The first and second concave sections serve for resting the end pieces on the coiling device and/or onto each other. Especially preferred the gliding section is integrally formed with the, preferably first and second, concave section. In an alternative the gliding section and the, preferably first and second, concave section are separate parts of the end piece fixed to each other. Preferably the concave section and the gliding section are aligned parallel to each other and parallel to a direction of movement for up rolling and unrolling the end pieces.

Preferably the shutter elements are guided within a slit of the side rails. Each side rail has a slit extending substantially vertically. The slits of both side rails are facing towards each other. The ends of the shutter elements, which are aligned in a at least substantially horizontal orientation, are extending through the slit into an interior space of the hollow side rails. The side rails may form a side frame guiding for guiding the shutter elements and/or the door blade in the area and/or a vertically plane of the doorway. Preferably the end pieces are at least substantially arranged and/or located inside the hollow side rails for opening and/or closing the doorway. At least one carrying strap may be connected with the end pieces and/or the coiling device to roll up and roll down the shutter elements. Thus, the end pieces and the carrying strap are arranged within the hollow side rails providing an aesthetical view and protection against damage and/or pollution. The carrying strap serves as a lifting device or lifting element. The carrying strap may be a belt. The carrying strap and/or the belt may flat and/or flexible to be wound an unwound in regard to a coiling device. In an alternative embodiment more than one carrying strap may be provided. In case of two, three or more carrying straps the carrying straps may be aligned parallel to each other.

According to a further embodiment the slide guide is arranged in the area of an upper end and/or upper opening of the side rail. If the end pieces are arranged within the hollow side rail the end pieces, preferably fixed to a carrying strap, are substantially aligned in a vertical direction to each other. Thus, no critical force, bending moment and/or torque is acting on the end pieces bending the end pieces out of the plane of the door blade. Therefore, the slide guide may only be needed for guiding the end pieces for the transition into and/or out of the upper end and/or upper opening of the side rail.

Preferably two opposed ends of the shutter elements are guided within a slit of the side rails. The width of the slit may be such that the shutter element is guided substantially frictionless within the vertical slit but at the same time the width of the slit may be as small as possible. The width of the slit may be only slightly thicker than the thickness of the shutter element and/or an end of the shutter element with a recess of an end piece encompassing the end of the shutter element. In case of a wind load acting on a closed door blade the ends of the shutter elements interact with the side rail avoiding any critical force, bending moment and/or torque on the end pieces and/or the carrying strap inside the hollow side rail. Preferably the width of the slit increases in the area of the slide guide for creating a funnel. The funnel may have an increasing opening towards the upper end of the side rail. The slide guide may push an end piece contacting the slide guide together with the assigned shutter element towards an edge of the slit. The two opposing vertical edges of the side rail forming the slit may comprise plastic bars. Thus, the arrangement of the slit in the side rail in combination with the slide guide in the upper area of the side rails allows a transition from the side rail to the coiling device and vice versa as well as a guidance of the shutter elements within the side rail without a critical force, bending moment and/or torque. The plane gliding section may be arranged for interacting with a slide guide of the side rail for leading the shutter elements into and/or out of the slit of the side rails. Thus, the slide guide is arranged to interact with the plane gliding section for leading the shutter elements into and/or out of the slit of the side rails. The slide guide is provided in addition to the slit of the side rails for leading the shutter elements into and/or out of the slit of the side rails. The shutter elements are guided by the slit in the side rails, i.e. when the shutter elements have been guided into the slit by the slide guide and the plane gliding section, the shutter elements are guided by the slit (during closing of the roller shutter); and the shutter elements are guided by the slit until the shutter elements are guided out of the slit by the slide guide and the plane gliding section (during opening of the roller shutter).

The slide guide may be arranged at and/or fixed to an inner side of the side rail. The slide guide may be fixed to the side rail inside an interior space of the hollow side rail. Especially preferred the slide guide is fixed at the inside of a side of the side rail, wherein the side of the side rail is assigned to an inner side of the roller shutter. Preferably a first section of the slide guide is arranged within the hollow side rail and a second section of the slide guide extends out of the side rail towards the coiling device. Thus, the slide guide supports the end pieces during the transition from the coiling device into the side rail and vice versa.

Preferably at least the upper end of the slide guide has a ramp-like design. In an alternative the upper end and the lower end have a ramp-like design. The ramp-like design is arranged for realizing a funnel-like guiding of the gliding sections of the end pieces. Preferably the ramp-like upper end and/or lower end of the slide guide is substantially directed and/or curved towards a rotation axis or shaft of the coiling device. The slide guide may be formed as a funnel. The funnel may have an outward expanding opening. Preferably the slide guide is a separate part and/or independent of a slit of the side rails for guiding the shutter elements. Preferably the slide guide is spatially spaced and/or decoupled from a slit of the side rail for guiding the shutter elements. The slide guide may be horizontally spaced from a slit of the side rail for guiding the shutter elements.

According to a further embodiment of the present invention the slide guide has a sliding face for contacting the plane gliding section of the end pieces. Preferably the gliding section has a plane and/or even gliding face for gliding on the slide guide, preferably the sliding face. The sliding face may be directed towards an inner side of the end pieces and/or the gliding section, preferably the gliding face, of the end pieces. The sliding face of the slide guide may be curved, bent and/or arched. Especially preferred the radius of a curved sliding face is bigger than the smallest radius of the coiling device without a partly and/or fully up rolled door blade. The radius of the curved sliding face may be chosen to ensure that the end pieces and/or the gliding section contacts the sliding face in a tangential way. By ensuring a tangential transition of the end pieces and/or the gliding sections to the slide guide, preferably during unrolling of the door blade, hitting and/or slamming of edges of the end pieces and/or gliding sections on the slide guide is avoided. The radius of the curved sliding face may be bigger than an average radius and/or a maximum radius of the coiling device without or including a partly or fully up rolled door blade. A curved shape of the sliding face may realize a ramp-like and/or funnel-like entry section and/or exit section of the slide guide.

Preferably the slide guide has a length for guiding at least two end pieces and their plane gliding sections at the same time. Especially preferred the slide guide has a length for guiding not more than three or four end pieces and at least a part of their plane gliding sections at the same time. The length of the slide guide may be arranged for supporting the end pieces only during the transition into and/or out of the hollow side rail. The slide guide extends out of the upper end of the side rail as far as possible for receiving the gliding section of the end pieces, but without touching the end pieces of an up rolled outermost layer of end pieces around the coiling device. The height of an upper section of the slide guide extending out of the upper end of the side rail may be in the range of the height of a single end piece and/or may be less than the height of a single end piece. Especially preferred only an upper section of the slide guide having a ramp-like and/or curved shape extends out of the upper end of the side rail.

According to a further embodiment the coiling device comprises two pairs of spiral discs, whereby one pair of spiral discs is arranged at each end of a rotatable shaft facing away from each other. The rotatable shaft is beared stationary such that a rotation around the longitudinal axis is possible but no movement of the shaft in a vertical and/or horizontal direction. Preferably a pair of spiral discs is arranged for receiving the concave sections of end pieces rolled up on the coiling device. Especially preferred the spiral discs of each pair have a distance to each other in the longitudinal direction of the shaft for receiving the plane gliding section of the end piece between the spiral disc. Thus, the spiral discs of a pair provides enough space between the spiral discs of the pair to place the gliding section between the spiral discs.

Preferably the end pieces of the upper shutter elements have the plane gliding section. Thus, not all end pieces have the gliding section. For example the end piece in a mid section and/or lower section of the door blade have not the gliding section. This may reduce the production costs for the roller shutter. Preferably only or not more than the end pieces of those shutter elements have the plane gliding section which are rolled up on and directly contact the coiling device to form a first layer of rolled up end pieces. Thus, only the end pieces may have the gliding section which are rolled up directly on the spiral discs. The end pieces which are rolled up on top of each other may have not the gliding section. In an alternative all end pieces of the roller shutter have the gliding section.

Preferably the end pieces are fixed to at least one carrying strap and only those end pieces have the plane gliding section whose assigned carrying strip section is deflected and/or displaced out of a vertical alignment by an angle greater than zero. A vertical alignment for the end pieces and/or the carrying strap may be given for those end pieces and/or the section of the carrying strap arranged within the hollow side rail. Only those end pieces may be fixed to the carrying strap whose elongated assigned carrying strip section is bent at the slide guide out of a vertical alignment. Except of a bent section and/or a bending point of the carrying strap at the slide guide the carrying strap extending away from the slide guide, the bent section and/or bending point may have an elongated shape and/or orientation. The angle may be greater than zero for end pieces fixed to shutter elements arranged in an upper and/or lower area of the door blade. Preferably the deflection of the end pieces and/or the carrying strip section is assigned to a transition area between the upper end of the side rail or slide guide and the coiling device. The end pieces and/or the carrying strap section of an upper area of the door blade may be deflected out of the vertical alignment towards an inner side and/or towards the axis of the coiling device. The end pieces and/or the carrying strap section of a lower area of the door blade may be deflected out of the vertical alignment towards an outer side and/or away from the axis of the coiling device. The end pieces and/or the carrying strap section of a mid area of the door blade may be aligned substantially in a vertical direction.

Preferably only those end pieces have a gliding section which are assigned to a deflection and/or a displacement of the carrying strap section out of the vertical towards the coiling device. The deflection and/or displacement of the carrying strap section assigned to the end pieces with the plane gliding section may be directed out of the plane of a at least partially closed door blade towards the coiling device. Especially preferred only the upper end pieces which are rolled up directly on and/or contacting the coiling device are equipped with the gliding section.

The shutter elements may be formed as slats, lamellae and/or panels which are connected with each other by a flexible hinge, a flexible joint and/or a flexible carrying strap for rolling up and unrolling the door blade on and off a coiling device. Preferably the shutter elements are foamed lamellae and/or insulated foamed sandwich panels. The foamed core may be enclosed by a sandwich sheet wall. The shutter elements may be elongated and/or oriented substantially in a horizontal direction. Preferably horizontal edges of adjacent shutter elements are configured to at least partially engage with each other in a horizontally pivoting fashion. The shutter elements may have window-like openings extending there through, by way of example for ventilation and/or visibility. The openings may be covered with transparent or translucent materials to limit ventilation and/or visibility. The shutter elements, especially preferred an outer shell, may be fabricated from rigid materials such as metal and/or plastic.

The roller shutter may be a high speed roller door. Preferably the door blade of the high speed roller door is moved in normal operation with a maximum speed in the range of 0.5 m/s to 5 m/s. Especially preferred is a maximum speed in normal operation in the range of 1 m/s to 3 m/s, particularly a speed of about 2 m/s.

In regard to high speed roller doors the topic energy saving becomes more and more important. To optimize the thermal insulation the thickness and/or height of the shutter elements may be increased. Common high speed roller doors have a maximum lamella thickness of approximately 20 mm and/or a lamella height in the range between 125 mm and 150 mm. Preferably the shutter elements according to the present invention have a height of more than 150 mm. The shutter elements may be insulated foamed sandwich panels with end pieces at their ends facing horizontally away from each other. By using insulated foamed sandwich panels the end pieces can only be fixed at relatively thin sandwich sheet walls. Therefore, the load, force, bending moment and/or torque which the connection of the end piece with the shutter element can withstand or resist is limited. If the force and/or torque is too high the shell of the shutter element may give in. This may lead to partial or total cut off of the end piece from the shutter element which may cause serious problems and/or damages to the roller shutter. Thus, a support in form of a gliding section in combination with a slide guide according to the present invention to reduce the force, bending moment and/or torque acting on the end piece in the area of the connection with the shutter element is especially advantageous in combination with a high speed roller door.

Figure 2:
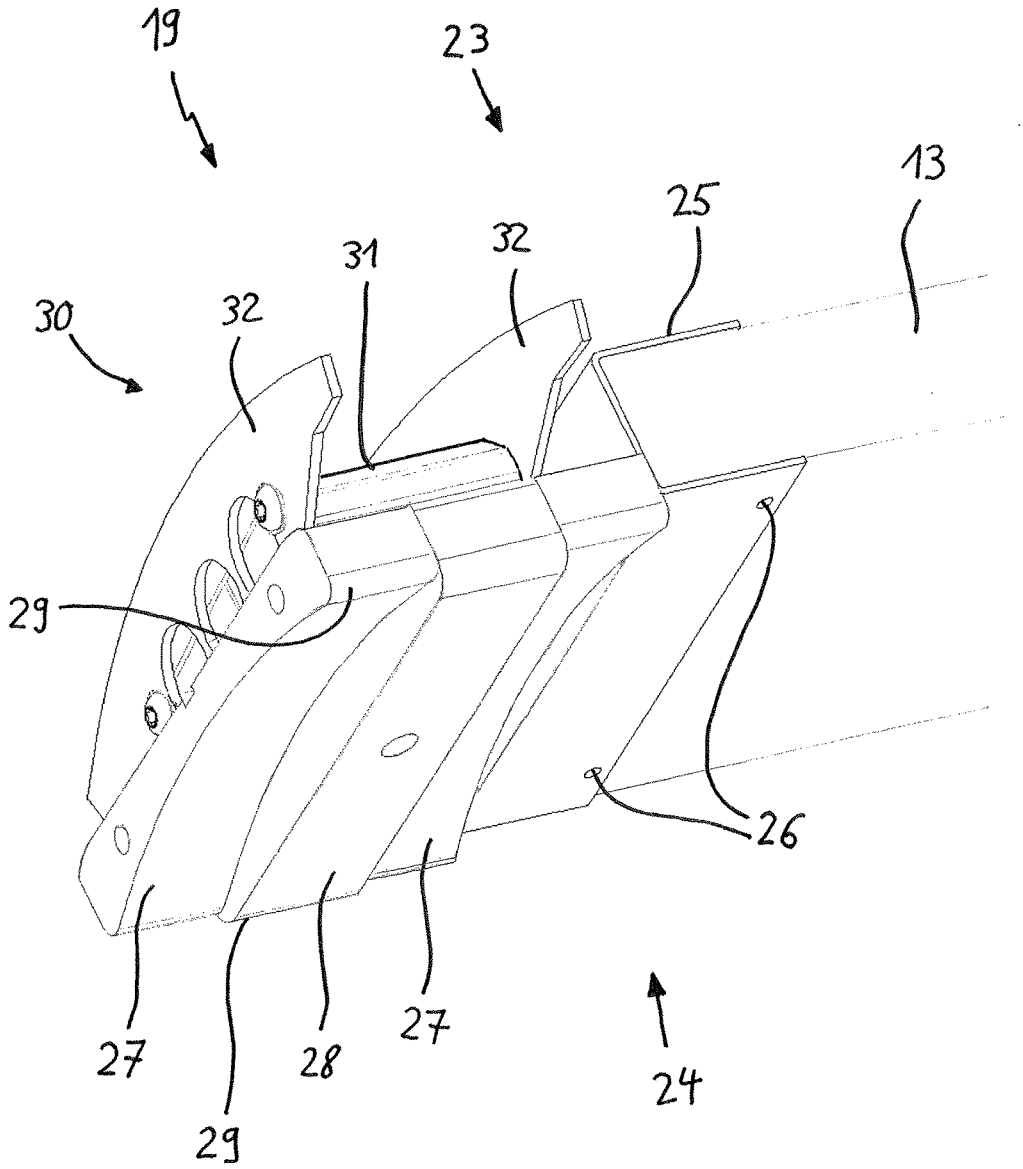
Figure 3:
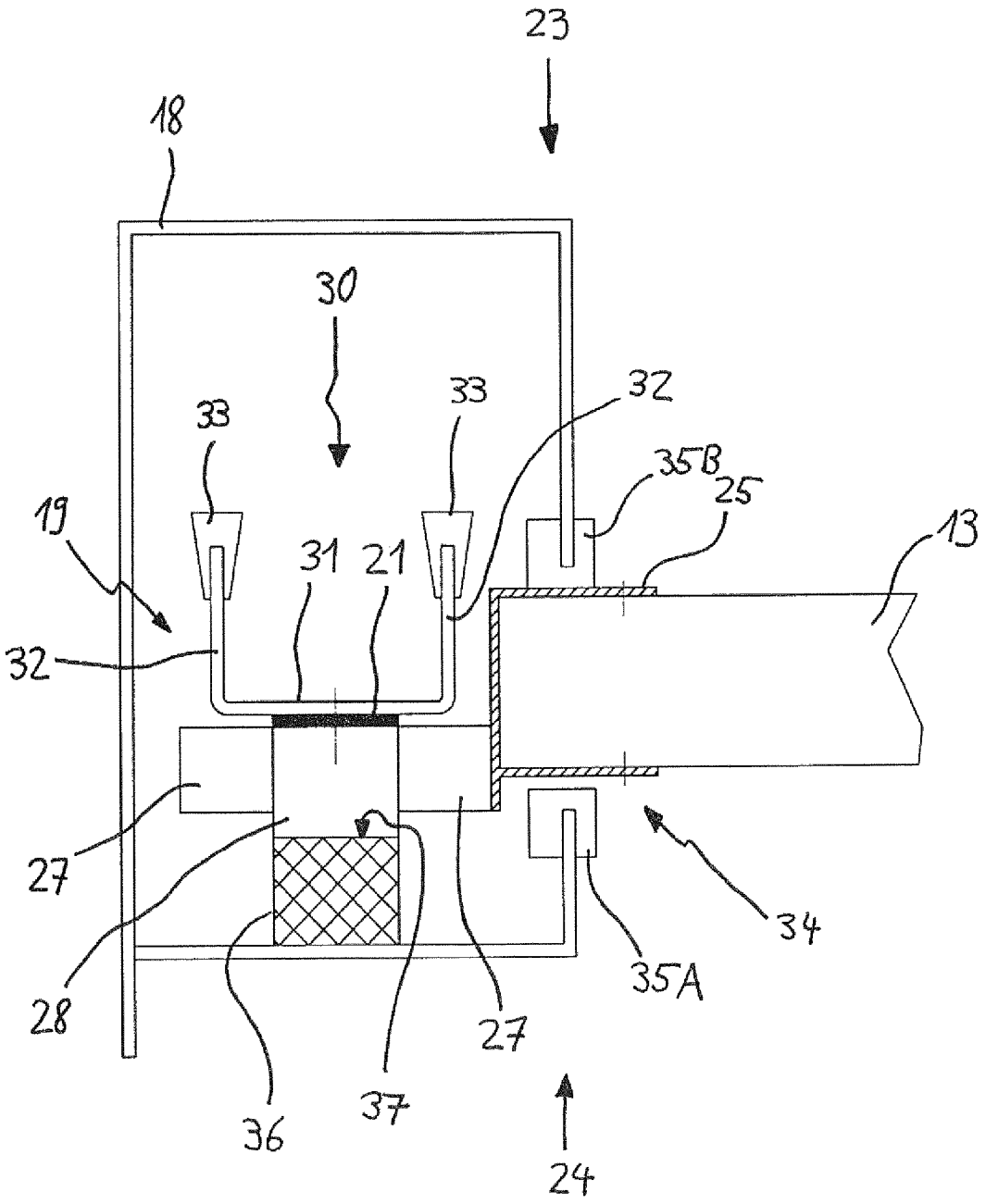
Figure 4:
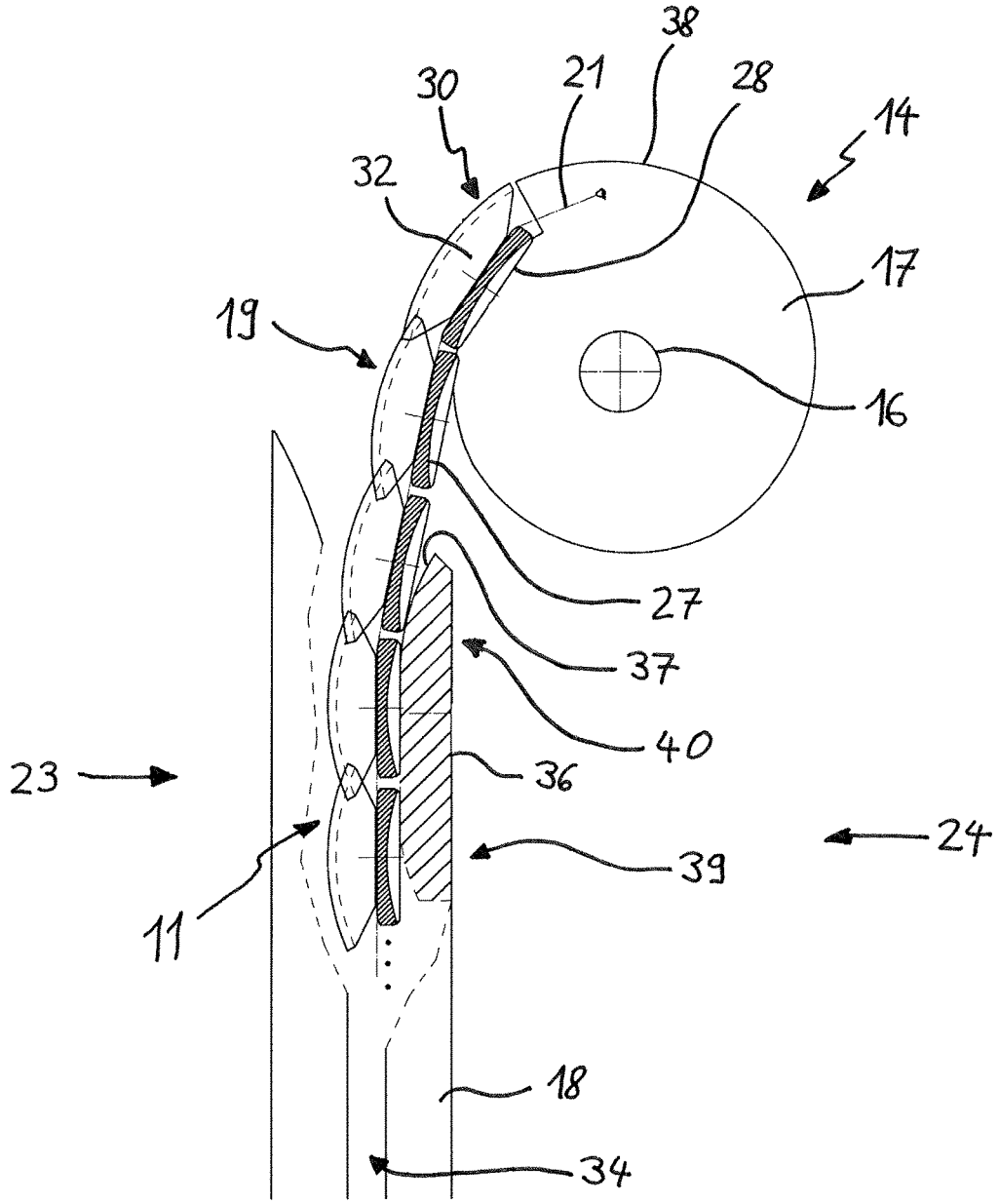
Figure 5:
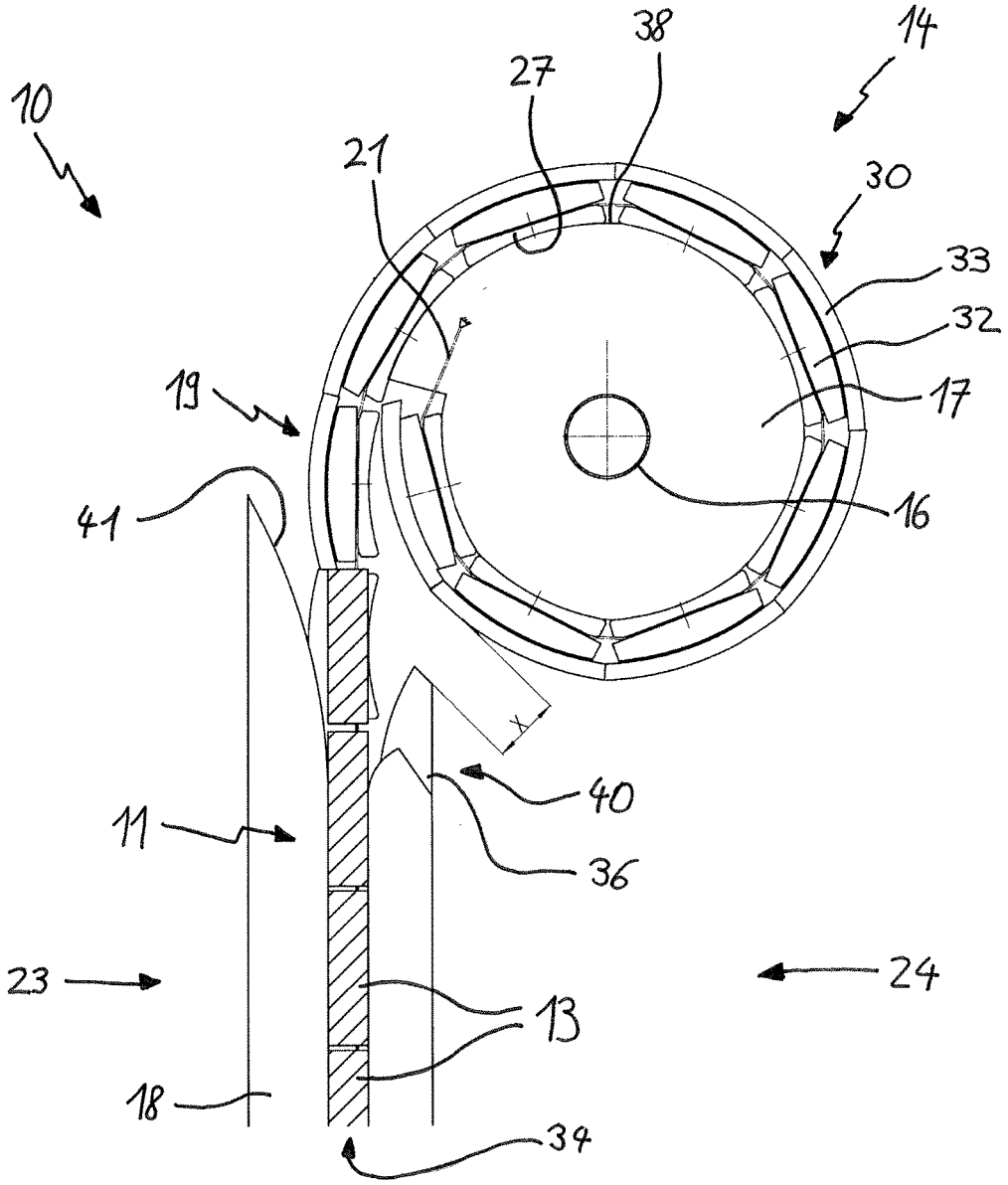
Figure 6:
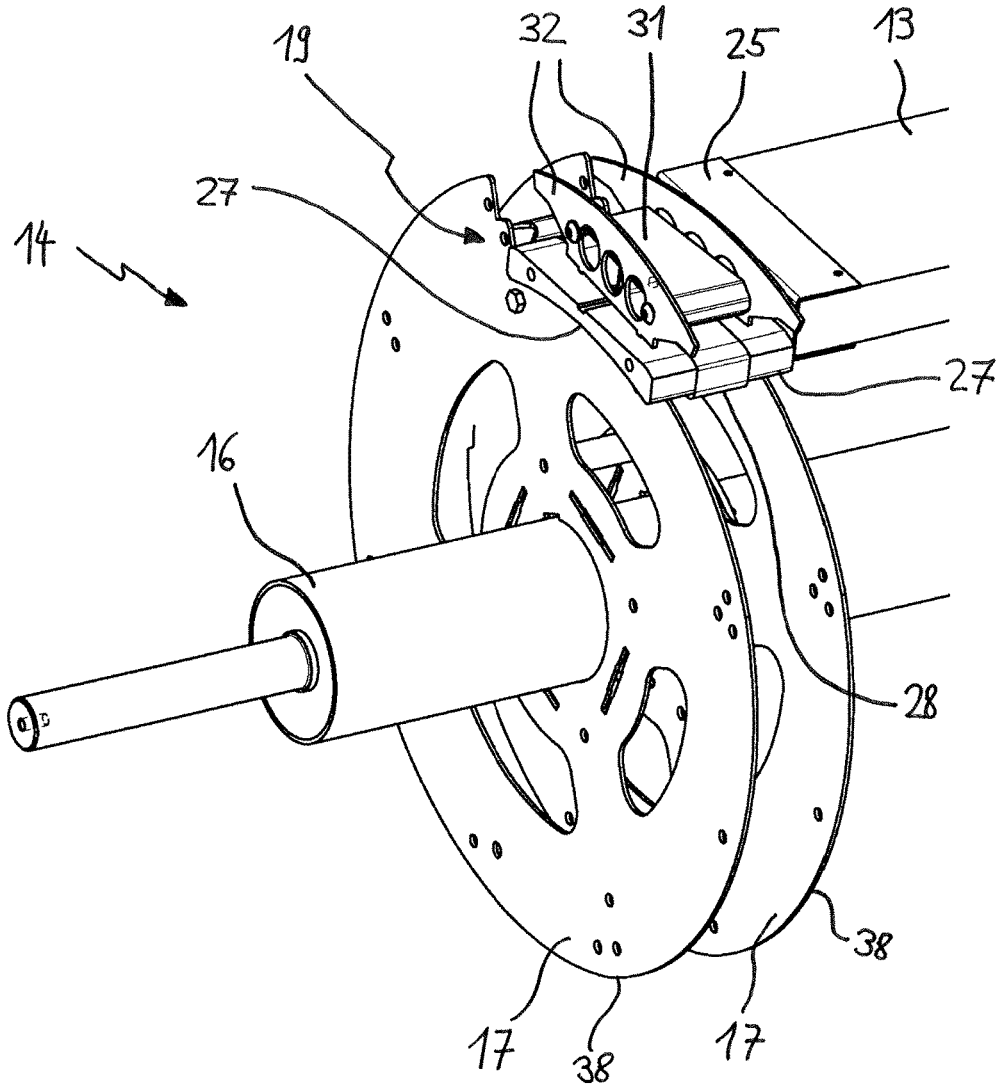
Figure 7:
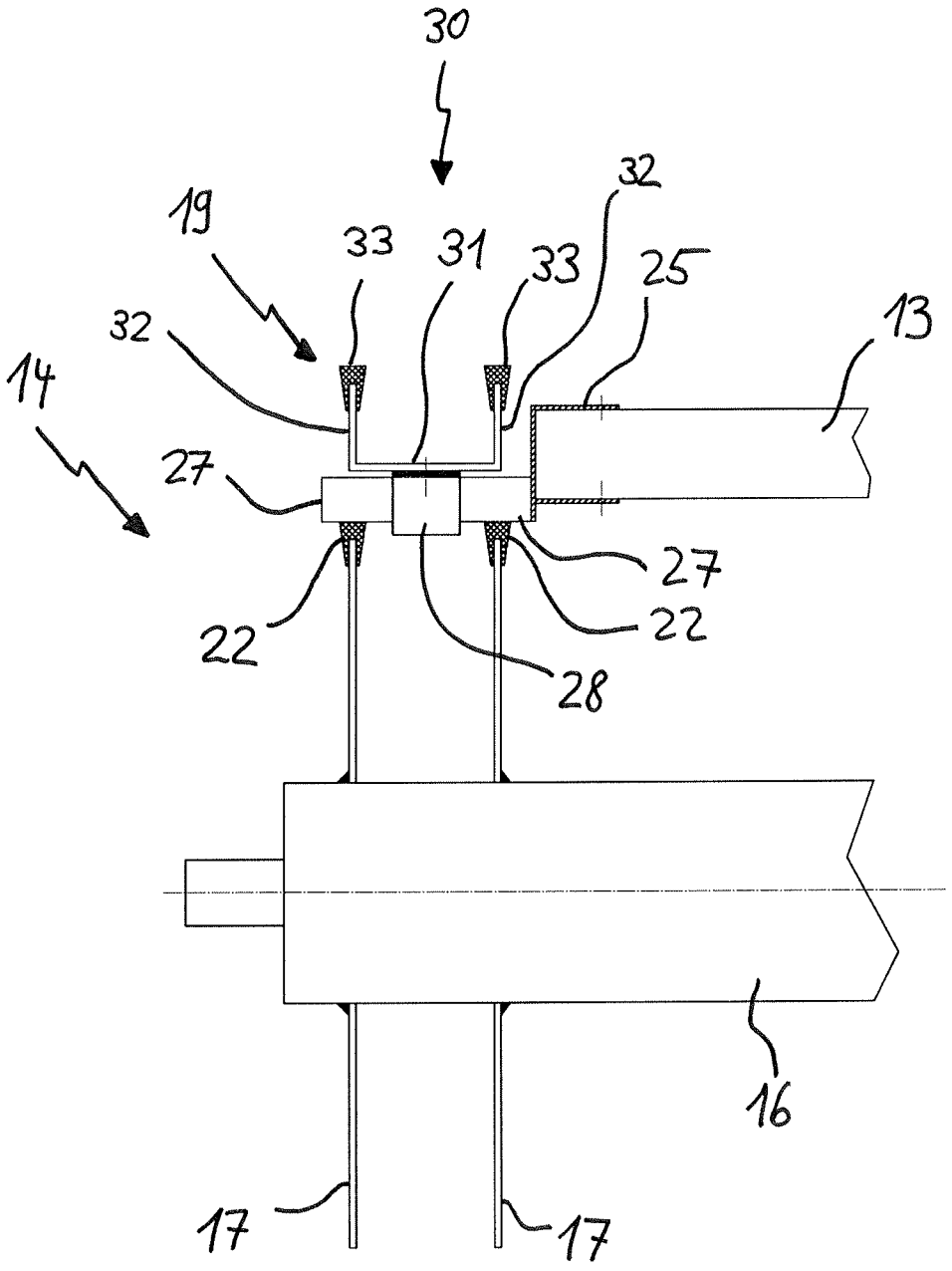

The following detailed description, given by way of example and not intended to limit the present invention solely thereto, will best be appreciated in conjunction with the accompanying figures, wherein like reference numerals denote like elements and parts, in which:

FIG. 1 is a schematic front view of a roller shutter according to the present invention, FIG. 2 is a schematic perspective view of an end piece fixed to an end of a shutter element for a roller shutter according to the present invention, FIG. 3 is a schematic cross section sectional top view of an end piece for a shutter element in a side rail of a roller shutter according to the invention, FIG. 4 is a schematic cross sectional side view of a detail and with partially removed elements of a roller shutter according to the invention, FIG. 5 is a further schematic cross sectional side view of a detail of a roller shutter according to the invention, FIG. 6 is a schematic perspective view of a detail of a coiling device for a roller shutter according to the invention, and FIG. 7 is a schematic cross sectional view of a detail of a coiling device for a roller shutter according to the invention.

The present invention will now be described more fully hereinafter with reference to the accompanying figures in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

The roller shutter will be described as a high speed roller door selectively blocking or opening a doorway. This recitation is for convenience only. It would be understood by one skilled in the art that such a roller door or rollup door is suitable for many embodiments and/or applications, including but not limited to industrial high speed rollup doors, interior doorway covering, exterior doorway covering, etc.

FIG. 1 is a schematic front view of a roller shutter 10 according to the present invention with partly removed elements. The roller shutter 10 has a door leaf or door blade 11. According to this figure the door blade 11 is shown in a fully unrolled position for closing a doorway 12. The door blade 11 comprises several shutter elements 13. For greater clarity not all shutter elements 13 provide a reference numeral. In this embodiment the shutter elements 13 are rigid and foamed lamellae 13. Thus, the lamellae 13 comprise a foamed core. The lamellae 13 are at least partly rotatable coupled to each other allowing up and unrolling of the lamellae 13 around a coiling device 14.

A drive system 15 provides a rotational force or torque to a rotatable shaft 16 of the coiling device 14 to raise or up roll the door blade 11 by rotating the coiling device 14 in a first direction and to lower or unroll the door blade 13 by rotating the coiling device 14 in a second direction opposite to the first direction.

The rotatable shaft 16 is part of a coiling device 14. According to this embodiment the coiling device 14 comprises four spiral discs 17. A pair of two spiral discs 17 is fixed to each end of the rotatable shaft 16. The rotatable shaft 16 is aligned in a horizontal direction.

The roller shutter 10 further comprises two side rails 18. The side rails 18 elongate or extends in a vertical direction and are designed to receive end pieces 19 of the lamellae 13 within the hollow side rails 18. In this figure only some end pieces 19 can be seen as a part of the right side rail 18 is removed.

The side rails 18, provided on both sides of the doorway 12, define the width of the passable doorway 12 and are configured to accept and guide the lamellae 13 within a slot or slit. Each lamella 13 provides two end pieces 19, one end piece 19 at each lamella end. The lamellae 13 elongate in a horizontal direction.

The lamellae 13 are connected pivotable with each other by a flexible carrying strap 21 connected to the end pieces 19. Between adjacent pivotable connected lamellae 13 a horizontal sealing 20 is provided avoiding the entry of moisture and/or dirt. The sealing 20 is flexible and in this embodiment the sealing 20 is made of an elastomer, preferably EPDM (Ethylene Eropylene Diene Monomer) or TPE (Thermo Plastic Elastomer). For greater clarity not all sealings 20 provide a reference numeral.

A carrying strap 21 is affixed at each side of the coiling device 14. In this embodiment the upper ends of both carrying straps 21 are fixed between the spiral discs 17 of a pair at each side of the coiling device 14 respectively. The carrying strap 21 is connected with the end pieces 19 to roll up and roll down the lamellae 13. The flexible carrying strap 21 realizes a flexible and/or hinged connection. The end pieces 19 are fixed to the carrying strap 21. One carrying strap 21 is provided on each side of the doorway 12 in conjunction with the end pieces 19 assigned to the side rails 18 at each side of the roller shutter 10. In one rotating direction of the coiling device 14 the carrying strap 21 with end pieces 19 will be hoisted and rolled up, causing the lamellae 13 to be wound up around the coiling device 14, opening the doorway 12. In second rotating direction of the coiling device 14 turned away from the first direction the carrying strap 21 with the end pieces 19 will unwind from its rolled up position, releasing the lamellae 13 to cover the doorway 12. The sections of the carrying straps 21 connected with up rolled end pieces 19 are arranged within or inside the hollow side rails 18.

Each spiral disc 17 comprises a damping profile 22 on its outer circumference leading to a reduction of noise when end pieces 19 are rolled on or rolled up the spiral discs 17. In this embodiment the damping profiles 22 are made of rubber leading to an anti-slip function which avoids movements of up rolled end pieces 19. Furthermore, the wear of a contacting face of end piece 19 is reduced.

FIG. 2 is a schematic perspective view of an end piece 19 fixed to an end of a shutter element 13 for a roller shutter 10 according to the present invention. The lamella 13 and the end piece 19 have an outer side 23 and an inner side 24. In a closed position of the door blade 11 the outer side 23 is directed outwards and the inner side 24 is directed inwards.

The end piece 19 has a substantially U-shaped recess 25. The recess 25 fits around an end of the lamella 13. The end piece 19 is connected to the lamella 13 by the recess 25 and fastening components 26, like bolts, rivets or screws. Additionally or in an alternative the end piece 19 and/or the recess may be glued to the lamella 13. At the inner side 24 the end piece 19 has according to this embodiment two concave sections 27. Upper and lower edges of the concave sections 27 protrude at the inner side 24 over the recess 25 and the lamella 13.

The end piece 19 has a plane and even gliding section 28 arranged at its inner side 24. According to this embodiment the plane gliding section 28 is arranged between the two concave sections 27. The gliding section 28 protrudes inwards and/or beyond the concave sections 27. The thickness of the gliding section 28 exceeds the thickness of the concave sections 27. Thus, the gliding section 28 is arranged as a protrusion at the inner side 24 projecting beyond all other parts of the end piece 19 and the lamella 13.

The concave sections 27 and the gliding section 28 have an elongated design, oriented perpendicular to the elongated design of the lamella 13 and in a plane parallel to the plane of the lamella 13.

Edges 29 of the gliding section 28 arranged at an upper and lower end in the longitudinal direction of the gliding section 28 are rounded. The gliding section 28 is made of a low friction, wear-resistant plastic material. In this embodiment the concave sections 27 and the gliding section 28 are made as separate elements mounted with each other. In an alternative the gliding section 28 may be integrally formed with the concave sections 27.

The end piece 19 comprises an outer convex section 30 at its outer side 23. The end piece 19 has a spacer 31. Each end piece 19 has a pair of spacer bars 32 connected with the spacer 31. The spacer bars 32 have a convex design, namely the outer faces of the spacer bars 32 form convex faces of the convex section 30. The spacer bars 32 are elongated perpendicular to the elongated design of the lamella 13 and in a plane parallel to the plane of the lamella 13. For spacing the spacer bars 32 from each other the spacer 31 is arranged between both spacer bars 32.

In an up rolled position of several end pieces 19 the convex section 30 provides convex contact faces on which subsequent end pieces 19, namely the concave sections 27, can rest.

The gliding section 28 is fixed to the carrying strap 21.

FIG. 3 is a schematic cross section sectional top view of an end piece 19 for a shutter element 13 in a side rail 18 of a roller shutter 10 according to the invention. As far as identical elements are concerned reference is made to the above mentioned description.

In this embodiment the spacer 31 is integrally formed with the spacer bars 32 in a U-shaped form. Furthermore according to this embodiment the convex face of the spacer bars 32 comprise a damping material 33 to reduce noise and/or wear when end pieces 19 are rolled onto or rolled up from each other.

The side rail 18 has a slit 34 for guiding an end of the lamella 13. The end of lamella 13 with the recess 25 of the end piece 19 extends through the slit 34 for arranging the end piece 19 substantially inside the hollow side rail 18. The outer face of the recess 25 serves as an abutment face for guiding the lamella 13 within the slit 34. To avoid noise and wear the edges of the side rail 18 forming the slit 34 comprises plastic bars 35A, 35B. Only in the area of a slide guide 36 the width of slit 34 is slightly bigger than the thickness of the lamella 13 with recess 25.

The slide guide 36 is partly arranged inside the hollow side rail 18 and connected with an inner side of the side rail 18. The slide guide 36 is positioned in the area of an upper opening of the side rail 18. A sliding face 37 of the slide guide 36 is facing and contacting the gliding section 28 of the end piece 19. By the slide guide 36 the end piece 19 contacting the slide guide 36 and the assigned lamella 13 are pushed outwards such that the outer side of the recess 25 is slightly pushed off the inner plastic bar 35A and towards the outer plastic bar 35B.

FIG. 4 is a schematic cross sectional side view of a detail and with partially removed elements of a roller shutter 10 according to the invention. As far as identical elements are concerned reference is made to the above mentioned description. The coiling device 14 is assigned to the inner side 24. Thus, the inner side 24 of the roller shutter 10 is at least partly directed or faced towards the coiling device 14. The outer side 23 of the roller shutter 10 is facing away from the inner side 24 and the coiling device 14.

This cross sectional side view shows only one spiral disc 17 of a pair of spiral discs 17. It is shown that the upper end of the carrying strap 21 is mounted to the spiral discs 17. The spiral discs 17 have a continuously increasing radius such that an outer circumference 38 of the spiral discs 17 comprises a mismatch. The smallest radius merges smoothly to the greatest radius over a rotation of approximately 360 degrees. Furthermore, the two spiral discs 17 of each pair are arranged as mirror images of each other.

According to this embodiment the greatest radius of the spiral discs 17 exceeds the smallest radius of the spiral discs 17 by a dimension at least substantially equal to the thickness of the end pieces 19.

The spacer bars 32 of adjacent end pieces 19 are overlapping each other. The spacer bars 32 of each end piece 19 extend over the concave section 27 to the concave section 27 of a preceding end piece 19 and a following end piece 19. Thus, the spacer bars 32 of two adjacent end pieces 19 overlap, thereby bridging a gap between adjacent end pieces 19 in a row connected to the carrying strap 21. In this embodiment the spacer bars 32 of each pair are inclined to each other. In an alternative embodiment the spacer bars 32 of each pair may be aligned parallel and/or shifted to each other. According to this figure an upper end piece 19 is rolled up on the spiral disc 17.

The slide guide 36 is assigned to an area of an upper end or upper opening of the side rail 18. For a better understanding parts of the side rail 18 have been removed which is indicated by the dashed line if the side rail 18. The upper opening of the side rail 18 serves as an inlet and outlet for the end pieces 19 into and out of the interior space of the hollow side rail 18. A first section 39 of the slide glide 36 is mounted inside the hollow side rail 18. A second section 40 of the slide guide 36 facing away from an end of the first section 39 extends out of the interior space of the side rail and substantially towards the coiling device 14. The slide guide 36 has a substantially vertical elongated design.

The slide face 37 of the slide guide 36 is facing the gliding section 28 of the end pieces 19. In this embodiment the slide face 37 has a plane middle section oriented vertically which is substantially arranged between the first section 39 and the second section 40 of the slide guide 36. The slide face 37 in the area of the first and second sections 39, 40 is curved away from the end pieces 19. Thus, the slide face 37 forms in the area of the first and second sections 39, 40 a ramp-like inlet or outlet for the gliding section 28 of the end pieces 19. This allows a tangential transition of the plane gliding section 28 onto the slide face 37. According to this embodiment the slide guide 36 has a length for guiding not more than three end pieces 19 at the same time.

FIG. 5 is a further schematic cross sectional side view of a detail of a roller shutter 10 according to the invention. This figure shows a partially rolled up door blade 11 with end pieces 19 establishing a first layer of end pieces 19 on the outer circumference 38 of the coiling device 14. According to this embodiment the carrying strap 21 extends in this partially up or unrolled position of the door blade 11 vertically from the coiling device 14 into the side rail 18. The doorway 12 is partly closed or opened and the shutter elements 13, guided by the slit 34 in the side rail 18, run straight or substantially vertically into or out of the side rail 18.

In case the door blade 11 would be rolled up the outer radius of the coiling device 14 with the layers of end pieces 19 would increase. Thus, the shutter elements 13 run over and/or along an outer radius 41 of an opening at an upper end of the side rail 18. The face of the outer radius 41 is substantially directed towards the coiling device 14. The outer radius 41 is assigned to the outer side 23 of the side rail 18. Furthermore, the upper end of the side rail 18 is in the area of the outer radius 41 higher than the upper end of the side rail 18 in the area of the slide guide 36. In this embodiment the upper end of the side rail 18 in the area of the outer radius 41 is higher than the upper end of the slide guide 36.

In case the door blade 11 would be unrolled the outer radius of the coiling device 14 with the layers of end pieces 19 would decrease. Thus, the gliding sections 28 would run over and/or along the slide face 37 of the slide guide 36 according to FIG. 4.

According to FIG. 5 a first layer of end pieces 19 on a pair of spiral discs 17 follows a smooth curve or radius as preset by the outer circumference 38 of the spiral discs 17. If the door blade 11 is further rolled up on the coiling device 14, each successive layer of end pieces 19 will lay smoothly on top the convex section 30, namely the outer convex surface of spacer bars 32, of the preceding layer of end pieces 19. The outer convex surface of spacer bars 32 may build an approximately continued outer spiral circumference 38 or provide a convex surface on the preceding layer of end pieces 19 and/or in continuation of the outer circumference 38 of the spiral discs 17.

The cross sections of end pieces 19 are chosen to substantially correspond to the outer circumference 38 of the spiral discs 17 and/or of the layers of up rolled end pieces 19 respectively. This allows successive layers of end pieces 19 wound onto or around the spiral discs 17 and onto preceding layers of end pieces 19 to present a smooth wound outer surface and a compact rolled up door blade 11. In this regard a geometric relationship has to be considered which combines the height of the doorway, the configuration of the spiral discs 17 and the height as well as the cross section of the end pieces 19. Each layer of rolled up end pieces 19 creates a greater diameter or radius of the coiling device 14 for successive layers to wind up onto. This may result in deviating cross sections, convex sections 30 and concave section 27 for each end piece 19 in a row as fixed to the carrying strap 21. Preferably a fully wound up door will require partial and/or full 360 degree revolutions, especially preferred one, two, three or more 360 degrees turns, of the shaft 16 depending on the height of the door blade 11 and/or doorway 12.

The upper free end of the second section 40 of the slide guide 36 is arranged between the upper end of the side rail 18 at the inner side 24 and the coiling device 14 such that the slide guide will not touch the outer layer of up rolled end pieces 19 for a fully up rolled door blade 11. At the same time the slide guide 36 extends out of the side rail 18 towards the coiling device 14 as much as possible for providing a guide for at least some of the end pieces 19 in a transition area between the upper end of the side rail 18 and the coiling device 14. A distance X between the outer circumference of the coiling device 14 and the upper end of the slide guide 36 depends on how many layers of end pieces 19 are rolled up on the coiling device 14. The distance X is greatest when no layer of end pieces 19 is rolled up the outer circumference 38 of the spiral discs 17. The distance X is smallest when the door blade 11 is fully rolled up on the coiling device 14. In the latter case the distance X should be as small as possible. Just a direct contact of the slide guide 36 with the outer circumference of the outer rolled up layer of end pieces 19 has to be avoided.

FIG. 6 is a schematic perspective view of a detail of a coiling device 14 for a roller shutter 10 according to the invention. For greater clarity only one end piece 19 with its assigned shutter element 13 is shown. The shutter element 13 is the top lamella of the door blade 11 according to FIG. 1. The end piece 19 is resting with its concave sections 27 on the outer circumference 38 of the spiral discs 17. The gliding section 28 is placed and extends between the spirals discs 17 of a pair at one end of the coiling device 14. Thus, the gliding section 28 is accommodated in a spacing within a pair of spiral discs 17.

FIG. 7 is a schematic cross sectional view of a detail of a coiling device 14 for a roller shutter 10 according to the invention. The spacer bars 32 are formed such that the total thickness of the end piece 19 exceeds the thickness of the lamella 13. The end piece 19 is arranged to the lamella 13 such that the end piece 19 protrudes the lamella 13 at its inner and its outer side. This avoids any contact of up rolled lamellae 13 with each other.

According to this embodiment the spacer bars 32 are spaced from each other for allowing a gliding section 28 of a subsequent layer of up rolled end pieces 19 (not shown) to be placed or received between the spacer bars 32 of the underlying end piece 19. Thus, the distance between two adjacent spacer bars 32 of the same end piece 19 is at least slightly greater than the width of the gliding section 28.

Although preferred embodiments of the present invention and modifications thereof have been described in detail herein, it is to be understood that this invention is not limited to these precise embodiments and variations and may be affected by one skilled in the art without departing from the spirit and scope of the invention as defined by the appended claims.

The use of expressions like: "particularly", "preferably" or "especially preferred" etc. is not intended to limit the invention. Features which are not specifically or explicitly described or claimed may be additionally included in the structure or method according to the present invention without deviating from its scope.

REFERENCE NUMERALS

10 roller shutter
11 doorblade
12 doorway
13 shutter element
14 coiling device
15 drive system
16 shaft
17 spiral disc
18 side rail
19 end piece
20 sealing
21 carrying strap
22 damping profile
23 outer side
24 inner side
25 recess
26 fastening component
27 concave section
28 gliding section
29 edge
30 convex section
31 spacer
32 spacer bar
33 dumping material
34 slit
35 plastic bar
36 slide guide
37 sliding face
38 outer circumference
39 first section
40 second section
41 outer radius

The invention claimed is:

1. A roller shutter for opening and closing a doorway having a door blade, the door blade comprises several shutter elements which are hinged with each other, the shutter elements are guided by side rails at opposed sides of the doorway, wherein each shutter element provides an end piece at each horizontally spaced end of the shutter element for spacing layers of rolled up shutter elements apart from each other, each end piece has at least one concave section for coiling the end pieces on a coiling device and/or in layers on top of each other, wherein at least some of the end pieces have at least one plane gliding section, the at least one plane gliding section facing in the same direction as the at least one concave section, wherein the at least one plane gliding section is arranged for interacting with a slide guide of each of the side rails for leading the end pieces into and/or out of the side rails, wherein a lifting device is connected with the end pieces to roll up and roll down the shutter elements, wherein each side rail has a slit extending substantially vertically and the shutter elements are guided within the slit.

2. The roller shutter according to claim 1, wherein the thickness of the at least one plane gliding section on each end piece with a gliding section exceeds the thickness of the concave sections on that end piece for avoiding any abutment of the concave sections with the slide guide.

3. The roller shutter according to claim 1, wherein the at least one gliding section on each end piece with a gliding section extends over the whole height of that end piece.

4. The roller shutter according to claim 1, wherein the at least one gliding section on each end piece with a gliding section is arranged between a first concave section and a second concave section of that end piece.

5. The roller shutter according to claim 1 wherein the side rails each further comprise an internal cavity, wherein the shutter elements are guided within the slits of the side rails and the end pieces are arranged inside the the cavities of the side rails.

6. The roller shutter according claim 5 wherein the slide guide of each side rail is at an upper end of that side rail, wherein a first section of the slide guide is arranged within the cavity of that side rail and wherein a second section of the slide guide extends out of the cavity of that side rail towards the coiling device.

7. The roller shutter according to claim 1, wherein the slide guide is arranged at an inner side of the its respective side rail, wherein at least the upper end of the slide guide has a ramp-like surface, and wherein the ramp-like surface is substantially directed towards an rotation axis of the coiling device.

8. The roller shutter according claim 1 wherein each slide guide has a curved sliding face for contacting the plane gliding section of the end pieces, wherein the sliding face is directed towards an inner side of the gliding section of the end pieces, and wherein the radius of the curved sliding face is larger than the smallest radius of the coiling device without a partly and/or fully up rolled door blade.

9. The roller shutter according to claim 1 wherein the slide guide has a length for guiding two, three, or four end pieces and their plane gliding sections at the same time.

10. The roller shutter according to claim 1 wherein the coiling device comprises two pairs of spiral discs, wherein a pair of spiral discs is arranged at each end of a rotatable shaft facing away from each other, wherein each pair of spiral discs is arranged for receiving the concave sections of end pieces of the shutter elements rolled up on the coiling device, and wherein each pair of spiral discs are spaced apart a distance to to receive the plane gliding section of the end piece between the spiral discs.

11. The roller shutter according to claim 1 wherein, when the shutter is rolled up, a first plurality of the end pieces form a first layer on the coiling device and wherein only the end pieces of the first plurality of end pieces include plane gliding sections.

12. The roller shutter according to claim 1, wherein the lifting device comprises carrying straps aligned with end pieces at each end of the shutter elements, wherein the end piece on each end of the shutter elements is fixed to a respective one of the carrying straps, wherein, when the lifting device rolls up and rolls down the shutter elements, a first plurality of shutter elements are deflected from a vertical direction when the end pieces of those shutter elements move into and out of the side rails, and wherein only those end pieces on the first plurality of shutter elements have plane gliding sections.

13. The roller shutter according to claim 1, wherein the shutter elements are formed as lamellae and wherein the lamellae are connected with each other by a joint.

14. The roller shutter according claim 1 wherein the door blade is moved in normal operation with a speed in the range of 0.5 m/s to 5 m/s.

15. The roller shutter of claim 1, wherein the edges of the gliding sections are rounded.

16. The roller shutter of claim 1, wherein, the gliding sections are made of one or more of a low friction material, a wear-resistant material, and a plastic.

17. The roller shutter of claim 1, wherein, the gliding section of an end piece is integrally formed with the concave section of that end piece.

18. The roller shutter of claim 2, wherein the thickness of the gliding section of an end piece exceeds the thickness of the concave section of that end piece by at least 2 mm.

* * * * *